US009476333B2

(12) United States Patent
Tsumagari et al.

(10) Patent No.: US 9,476,333 B2
(45) Date of Patent: Oct. 25, 2016

(54) BURNER FOR EXHAUST PURIFYING DEVICE

(71) Applicants: HINO MOTORS, LTD., Tokyo (JP); SANGO CO., LTD., Aichi-ken (JP)

(72) Inventors: Ichiro Tsumagari, Hino (JP); Ryo Shibuya, Hino (JP); Atsushi Koide, Miyoshi (JP)

(73) Assignee: HINO MOTORS, LTD., Tokyo (JP)

( * ) Notice: Subject to any disclaimer, the term of this patent is extended or adjusted under 35 U.S.C. 154(b) by 0 days.

(21) Appl. No.: 14/359,259

(22) PCT Filed: Aug. 8, 2013

(86) PCT No.: PCT/JP2013/071452
§ 371 (c)(1),
(2) Date: May 19, 2014

(87) PCT Pub. No.: WO2014/024953
PCT Pub. Date: Feb. 13, 2014

(65) Prior Publication Data

US 2014/0318107 A1 Oct. 30, 2014

(30) Foreign Application Priority Data

Aug. 8, 2012 (JP) ..... 2012-175950

(51) Int. Cl.
*F01N 3/025* (2006.01)
*F01N 3/36* (2006.01)
(Continued)

(52) U.S. Cl.
CPC ..... *F01N 3/0256* (2013.01); *F01N 3/025* (2013.01); *F01N 3/035* (2013.01); *F01N 3/36* (2013.01);
(Continued)

(58) Field of Classification Search
CPC ..... F01N 3/0256; F01N 3/025; F01N 3/36; F01N 3/035; F01N 2240/14; F01N 2240/20; F23C 7/002; F23C 7/004; F23D 11/408; F23D 11/24; F23D 11/402; F23D 91/02; F23D 2900/21006
USPC ..... 431/9, 185, 8, 12, 169, 173, 183, 187, 431/188; 60/217
See application file for complete search history.

(56) References Cited

U.S. PATENT DOCUMENTS 3,374,857 A * 3/1968 Hutchins ..... F01N 1/08 181/227
3,922,335 A * 11/1975 Jordan ..... C09C 1/50 422/150
(Continued)

FOREIGN PATENT DOCUMENTS

CH EP 0704657 A2 * 4/1996 ..... F23D 11/402
CH DE 19859829 A1 * 6/2000 ..... F23C 7/002
(Continued)

OTHER PUBLICATIONS

Extended Search Report for European Patent Application No. 13828171.2, dated May 26, 2015, 6 pages.
(Continued)

*Primary Examiner* — Gregory Huson
*Assistant Examiner* — Daniel E Namay
(74) *Attorney, Agent, or Firm* — Sheridan Ross P.C.

(57) ABSTRACT

A burner for an exhaust purifying device includes a tube, an air supply port for supplying air for combustion into the tube, a fuel supply port for supplying fuel into the tube, and an ignition portion. The tube includes a premixing chamber for mixing air for combustion and fuel to generate a pre-mixed air-fuel mixture, a combustion chamber for combusting the pre-mixed air-fuel mixture to generate post-combustion gas, and a discharge port for discharging the post-combustion gas. The ignition portion ignites the pre-mixed air-fuel mixture in the combustion chamber. The tube further includes a swirling flow generation unit arranged upstream of the premixing chamber for generating a swirling flow of which the center direction corresponds to a fuel injection direction and a diffusion unit arranged downstream of the swirling flow generation unit in the premixing chamber for diffusing the fuel incorporated in the swirling flow.

6 Claims, 9 Drawing Sheets

(51) Int. Cl.

| | |
|---|---|
| ***F23C 7/00*** | (2006.01) |
| ***F23D 11/40*** | (2006.01) |
| ***F23D 11/24*** | (2006.01) |
| ***F01N 3/035*** | (2006.01) |

(52) U.S. Cl.

CPC ..... *F23C 7/002* (2013.01); *F23D 11/24* (2013.01); *F23D 11/402* (2013.01); *F23D 91/02* (2015.07); *F01N 2240/14* (2013.01); *F01N 2240/20* (2013.01); *F23D 2900/21006* (2013.01)

(56) References Cited

U.S. PATENT DOCUMENTS

| | | | | |
|---|---|---|---|---|
| 4,013,396 | A | 3/1977 | Tenney | |
| 5,105,621 | A * | 4/1992 | Simmons | F01N 3/0256 422/183 |
| 5,320,523 | A | 6/1994 | Stark | |
| 5,415,114 | A * | 5/1995 | Monro | F23D 1/02 110/264 |
| 5,761,897 | A * | 6/1998 | Kramer | F23C 7/002 60/737 |
| 6,155,820 | A * | 12/2000 | Dobbeling | F23C 7/002 239/403 |
| 6,896,509 | B2 * | 5/2005 | Carroni | F23R 3/40 431/170 |
| 7,491,056 | B2 * | 2/2009 | Knoepfel | F23C 7/002 431/351 |
| 7,871,262 | B2 * | 1/2011 | Carroni | F23C 7/002 431/1 |
| 8,033,821 | B2 * | 10/2011 | Eroglu | F23C 7/002 431/12 |
| 8,429,914 | B2 * | 4/2013 | Gashi | F23D 11/107 239/402 |
| 8,869,518 | B2 * | 10/2014 | Yetkin | F01N 3/025 60/303 |
| 9,033,697 | B2 * | 5/2015 | Kostlin | F02C 7/26 110/347 |
| 2003/0031972 | A1 * | 2/2003 | Griffin | F23C 7/002 431/354 |
| 2004/0142294 | A1 * | 7/2004 | Niass | F23C 7/002 431/278 |
| 2004/0146820 | A1 * | 7/2004 | Carroni | F23R 3/40 431/7 |
| 2006/0070375 | A1 * | 4/2006 | Blaisdell | F01N 1/003 60/324 |
| 2007/0056263 | A1 * | 3/2007 | Roach | F01N 3/025 60/272 |
| 2007/0202453 | A1 * | 8/2007 | Knoepfel | F23C 7/002 431/354 |
| 2008/0193886 | A1 * | 8/2008 | Amano | F23C 3/006 431/9 |
| 2008/0264048 | A1 * | 10/2008 | Nishiyama | B01D 53/9431 60/299 |
| 2008/0280239 | A1 * | 11/2008 | Carroni | F23C 7/002 431/9 |
| 2009/0142716 | A1 * | 6/2009 | Jubb | F23R 3/14 431/9 |
| 2009/0255242 | A1 * | 10/2009 | Paterson | B01F 3/02 60/320 |
| 2010/0011772 | A1 * | 1/2010 | Gashi | F23D 11/107 60/748 |
| 2010/0146939 | A1 * | 6/2010 | Sim | F01N 3/0256 60/286 |
| 2010/0190119 | A1 * | 7/2010 | Perry | F23C 6/047 431/9 |
| 2010/0273117 | A1 * | 10/2010 | Eroglu | F23C 7/002 431/9 |
| 2010/0281872 | A1 * | 11/2010 | Hadley | F23D 14/58 60/748 |
| 2011/0061369 | A1 * | 3/2011 | Yetkin | F01N 3/025 60/282 |
| 2011/0250098 | A1 * | 10/2011 | Matveev | F23C 3/006 422/186.03 |
| 2012/0291446 | A1 * | 11/2012 | Hirata | F23D 11/402 60/772 |
| 2012/0322012 | A1 | 12/2012 | Tsumagari et al. | |
| 2015/0211734 | A1 * | 7/2015 | Tsumagari | F01N 3/2033 431/354 |

FOREIGN PATENT DOCUMENTS

| | | | | |
|---|---|---|---|---|
| CH | DE 19914666 | A1 * | 10/2000 | F23C 7/002 |
| EP | 0797051 | A2 * | 3/1997 | F23C 7/00 |
| GB | 2096761 | A * | 10/1982 | F23D 11/402 |
| JP | 51-45334 | | 4/1976 | |
| JP | 60-58810 | U | 4/1985 | |
| JP | 2000-146123 | | 5/2000 | |
| JP | 2003-49636 | A | 2/2003 | |
| JP | 2011-185493 | A | 9/2011 | |
| NL | DE 10042315 | A1 * | 3/2002 | F23C 7/002 |
| WO | WO 2004/055437 | | 7/2004 | |
| WO | WO 2012/046126 | | 4/2012 | |

OTHER PUBLICATIONS

Official Action with English Translation for China Patent Application No. 201380004661.5, dated Aug. 4, 2015, 10 pages.

International Search Report prepared by the Japanese Patent Office on Nov. 5, 2013, for International Application No. PCT/JP2013/071452.

* cited by examiner

BURNER FOR EXHAUST PURIFYING DEVICE

CROSS-REFERENCE TO RELATED APPLICATIONS

This application is a national stage application under 35 U.S.C. 371 and claims the benefit of PCT Application No. PCT/JP2013/071452 filed 8 Aug. 2013, which designated the United States, which PCT Application claimed the benefit of Japanese Patent Application No. 2012-175950 filed on 8 Aug. 2012, the disclosure of each of which are incorporated herein by reference.

FIELD OF THE INVENTION

The present invention relates to a burner for an exhaust purifying device, which is used in an exhaust purifying device for purifying exhaust from an internal-combustion engine (hereinafter referred to as an engine) and raises the temperature of the exhaust.

BACKGROUND OF THE INVENTION

Conventional diesel engines include, in the exhaust passage, a diesel particulate filter (DPF), which captures particulates contained in exhaust, and an exhaust purifying device, which includes an oxidation catalyst. Such an exhaust purifying device treats exhaust to raise the temperature in order to maintain the function of purifying exhaust. The treatment regenerates the DPF by burning the particulates captured by the DPF and activates the oxidation catalyst.

For example, Patent Document 1 discloses a combustor arranged upstream of a DPF and an oxidation catalyst. Exhaust gas with the temperature raised by the combustor is sent to the DPF and the oxidation catalyst, so that the DPF is regenerated and the oxidation catalyst is activated. The combustor includes a premixing chamber, in which fuel gas and exhaust are mixed to generate a pre-mixed air-fuel mixture. The pre-mixed air-fuel mixture is sent to an ignition device (not shown).

PRIOR ART DOCUMENT

Patent Document

Patent Document 1: Japanese Laid-Open Patent Publication 2003-49636

SUMMARY OF THE INVENTION

It is difficult to form a pre-mixed air-fuel mixture having even fuel concentration distribution. Post-combustion gas contains a certain amount of non-combusted fuel due to uneven fuel concentration distribution in a pre-mixed air-fuel mixture. The non-combusted fuel in the post-combustion gas is unfavorable since it leads to unnecessary fuel consumption. Preferably, the post-combustion gas has a reduced amount of non-combusted fuel also for environmental considerations.

It is an object of the present invention to provide a burner for an exhaust purifying device that reduces a discharge amount of non-combusted fuel by homogenizing the fuel concentration distribution.

In accordance with one aspect of the present disclosure, a burner for an exhaust purifying device is provided. The burner comprises: a tube, which includes a premixing chamber for mixing air for combustion and fuel to generate a pre-mixed air-fuel mixture, a combustion chamber for combusting the pre-mixed air-fuel mixture to generate post-combustion gas, and a discharge port for discharging the post-combustion gas; an air supply port for supplying the air for combustion into the tube; a fuel supply port for supplying fuel into the tube; and an ignition portion for igniting the pre-mixed air-fuel mixture in the combustion chamber. The tube further includes a swirling flow generation unit, which is arranged upstream of the premixing chamber and generates a swirling flow of which a center direction corresponds to a fuel injection direction, and a diffusion unit, which is arranged downstream of the swirling flow generation unit in the premixing chamber and diffuses the fuel incorporated in the swirling flow.

According to the present embodiment, fuel is injected toward the center of a swirling flow generated by the swirling flow generation unit. The fuel spreads outward from the center of the swirling flow while being caught in the swirling flow. The diffusion unit diffuses the fuel into the premixing chamber. This minimizes the unevenness in the concentration distribution of the fuel in the pre-mixed air-fuel mixture. That is, before the pre-mixed air-fuel mixture is supplied to the combustion chamber, the fuel concentration distribution is homogenized in the radial direction of the tube. This reduces the discharge amount of non-combusted fuel, which results from the unevenness in the fuel concentration distribution.

In one embodiment, the diffusion unit includes a connecting hole having a diameter less than the inner diameter of the tube.

In this case, since the diffusion unit including the connecting hole is arranged downstream of the swirling flow generation unit, the pre-mixed air-fuel mixture remains in the swirling state and passes through the connecting hole. Then, the pre-mixed air-fuel mixture is discharged downstream of the connecting hole. When a contracted flow with an increased flow velocity is formed around the outlet of the connecting hole, the downstream pressure of the connecting hole decreases to be lower than the upstream pressure. For this reason, the swirling fuel in the contracted flow spreads at once in the premixing chamber. For this reason, the fuel concentration distribution of the pre-mixed air-fuel mixture supplied to the combustion chamber is homogenized in the radial direction of the tube.

In one embodiment, the connecting hole of the diffusion unit is arranged on an injection center line in the fuel injection direction.

In this case, since the connecting hole of the diffusion unit is arranged on the injection center line, a large amount of the injected fuel is discharged downstream of the diffusion unit. This reduces the amount of fuel that spreads to the inner surface of the tube without flowing into the connecting hole, that is, the amount of fuel that does not contribute to combustion.

In one embodiment, a ratio of the diameter of the connecting hole to the inner diameter of the tube is within a range between 0.25 and 0.33, inclusive.

In this case, since the ratio of the inner diameter of the connecting hole to the inner diameter of the tube is within the above range, the pre-mixed air-fuel mixture is supplied to the combustion chamber with an even fuel concentration in the radial direction of the tube.

In one embodiment, the diffusion unit includes a shielding portion facing in the fuel injection direction, an opening arranged around the shielding portion, and a swirler for swirling the pre-mixed air-fuel mixture sent from the opening in a predetermined direction.

In this case, fuel injected to the center of the swirling flow hits the shielding portion. This generates shear force in the pre-mixed air-fuel mixture and promotes mixture of fuel and air for combustion. When the mixed pre-mixed air-fuel mixture is discharged downstream of the premixing chamber through the opening, the swirler generates the swirling flow. This further mixes the downstream pre-mixed air-fuel mixture of the premixing chamber in the radial direction of the combustion chamber. For this reason, the combustion chamber is supplied with the pre-mixed air-fuel mixture having homogenized fuel concentration distribution.

In one embodiment, the swirler is inclined relative to the shielding portion at an angle in a range from 55° to 70°, inclusive.

In this case, since the swirler, which generates the swirling flow, is inclined at an angle within the above range, the combustion chamber is supplied with the pre-mixed air-fuel mixture having an even fuel concentration in the radial direction of the tube.

In one embodiment, the burner for an exhaust purifying device further comprises a porous plate arranged between the premixing chamber and the combustion chamber.

In this case, since the porous plate is arranged between the premixing chamber and the combustion chamber, the downstream premixing chamber is defined and formed between the diffusion unit and the combustion chamber. The swirling flow is therefore readily generated in the downstream premixing chamber while suppressing backfire from the combustion chamber. Thus, the mixing efficiency is improved.

DETAILED DESCRIPTION OF THE PREFERRED EMBODIMENTS

First Embodiment

A first embodiment of a burner for an exhaust purifying device according to the present invention will now be described with reference to FIG. 1 to FIG. 8.

Figure 1:
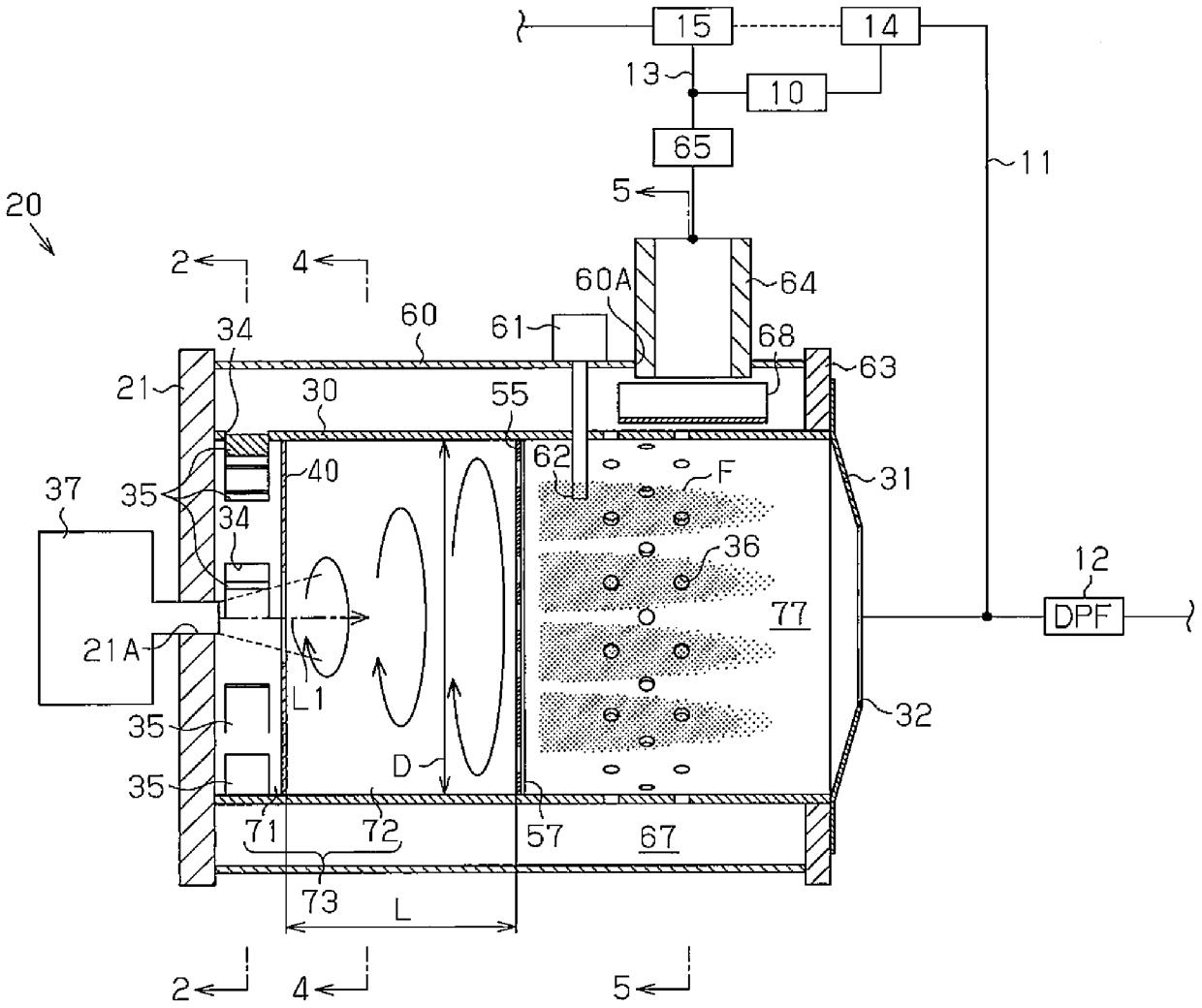
FIG. 1 is a schematic view of a burner for an exhaust purifying device according to a first embodiment of the present invention.

As shown in FIG. 1, a diesel engine 10 includes a DPF 12, which captures particulates contained in exhaust, in the exhaust passage 11. The DPF 12 has a honeycomb structure made of, for example, a porous silicon carbide and captures particulates in the exhaust. A burner for an exhaust purifying device 20 (hereinafter, simply referred to as a burner 20) is arranged upstream of the DPF 12. The burner 20 carries out a regeneration process of the DPF 12 by raising the temperature of exhaust flowing into the DPF 12.

The burner 20 has a dual tube structure including a substantially cylindrical first tube 30 and a second tube 60 having an inner diameter greater than that of the first tube 30. The first tube 30 includes openings at two ends in the direction parallel to the central axis (the axial direction). The first tube 30 includes a basal end portion as a first end portion in the axial direction or a bottom portion, and includes a head portion as a second end portion in the axial direction. The bottom of the first tube 30 is fixed to a basal plate 21, which closes the opening of the bottom portion. A substantially annular ejection plate 31 is arranged at the opening of the head portion in the first tube 30. An ejection port 32 as an exhaust port extends through the center of the ejection plate 31.

Figure 2:
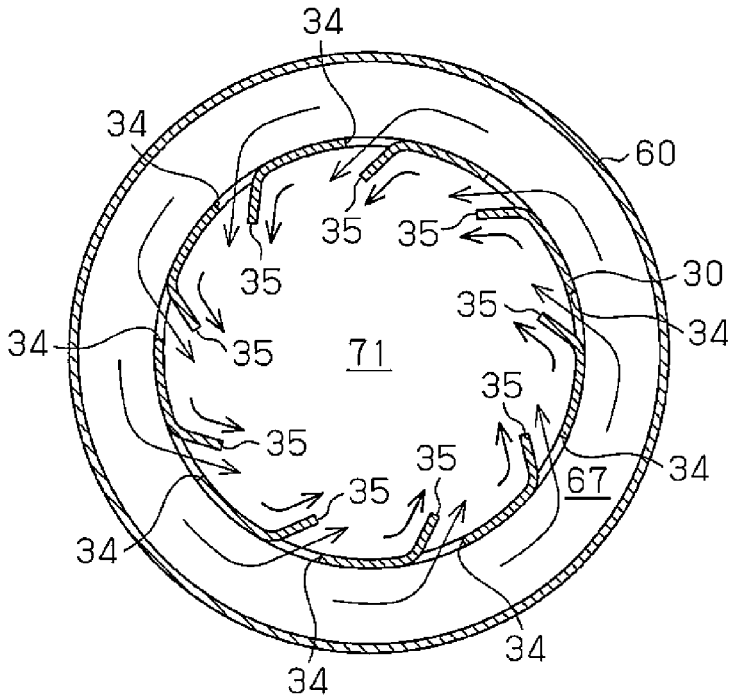
FIG. 2 is a cross-sectional view taken along line 2-2 of FIG. 1.

The swirling flow generation unit includes raised pieces 35 arranged in the basal end portion of the first tube 30. As shown in FIG. 2, the raised pieces 35 are formed by cutting and raising parts of the circumferential wall of the basal end portion inward in the radial direction. The raised pieces 35 are arranged at equal intervals in the circumferential direction of the basal end portion. First introduction holes 34 are formed to connect the exterior of the first tube 30 to the interior by forming the raised pieces 35.

As shown in FIG. 1, a plurality of second introduction holes 36 extends through in a portion closer to the head of the first tube 30. The second introduction holes 36 are shaped circular, and formed at equal intervals in the circumferential direction of the first tube 30.

As shown in FIG. 1, the basal plate 21 includes a fuel supply port 21A arranged at the substantially central position in the radial direction of a first mixing chamber 71 to fix the injection port of a fuel supply unit 37. The fuel supply unit 37 is connected to a fuel pump and a fuel valve (neither is shown). Opening the fuel valve sends fuel to the fuel supply unit 37. The fuel sent to the fuel supply unit 37 is vaporized in the fuel supply unit 37 and injected to the first mixing chamber 71.

Figure 3:
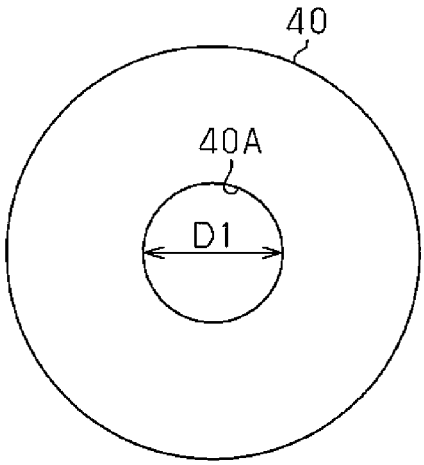
FIG. 3 is a plan view of an orifice plate provided in the burner in FIG. 1.

As shown in FIG. 1, a diffusion unit includes an orifice plate 40 arranged next to the raised pieces 35 closer to the ejection port 32 in the interior of the first tube 30. As shown in FIG. 3, the orifice plate 40 is disc-shaped and has a diameter substantially the same as the inner diameter of the first tube 30. The outer circumferential edge of the orifice plate 40 is joined with the inner surface of the first tube 30. An orifice hole 40A as a connecting hole extends through the center of the orifice plate 40. The opening area A2 of the orifice hole 40A is less than a total opening area A1 that is the sum of the opening areas of the first introduction holes 34 arranged on the first tube 30, that is, A1>A2. As shown in FIG. 1, the orifice plate 40, the basal plate 21, and the basal end portion of the first tube 30 define and form the first mixing chamber 71. As shown in FIG. 1, the orifice hole 40A is arranged at a position corresponding to a fuel injection direction, which is a direction in which the fuel supply unit 37 injects fuel. In more detail, the orifice hole 40A is arranged on the injection center line L1, which represents the center of the fuel injection.

Figure 4:
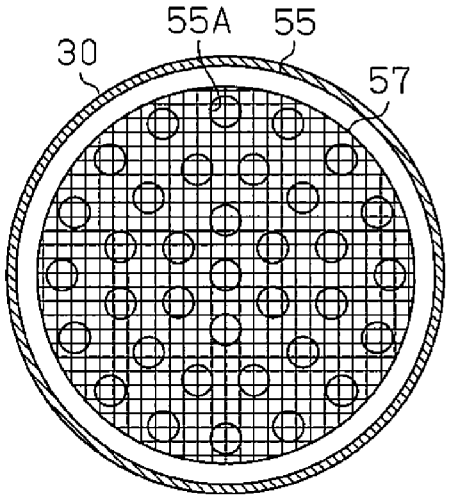
FIG. 4 is a cross-sectional view taken along line 4-4 of FIG. 1.

As shown in FIG. 1, a burner head 55 including a porous plate is arranged between the orifice plate 40 and the second introduction holes 36 in the interior of the first tube 30. The burner head 55 is disc-shaped having a diameter substantially the same as the inner diameter of the first tube 30, and the outer circumferential edge is joined with the inner surface of the first tube 30. As shown in FIG. 4, a large number of circular supply holes 55A extend through the burner head 55 in the thickness direction of the burner head 55. A metal mesh 57 is arranged on the surface of the burner head 55 closer to the ejection port 32 in order to avoid backfire. Although the present embodiment arranges the metal mesh 57 on the surface of the burner head 55 closer to the ejection port 32, the metal mesh 57 may be arranged on the surface of the burner head 55 closer to the basal plate 21 or on the two surfaces.

The total opening area A3 of the supply holes 55A, which is the sum of the opening areas of the supply holes 55A, is greater than the opening area A2 of the orifice hole 40A (A3>A2). The total opening area A3 of the supply holes 55A is set so that the flow velocity of pre-mixed air-fuel mixture flowing into the combustion chamber 77 is greater than the propagation speed of flame F based on a simulation result using parameters of various information such as an amount of fuel supply, an introduction amount of air for combustion, and the opening area of an orifice hole 40A. The axial length of the flame F formed in the first tube 30 (flame length) is adjustable by changing the number of the supply holes 55A. Thus, the number of the supply holes 55A is set considering the flame length so that the capacity of the burner 20 complies with the specification at the time while ensuring the volume of the combustion chamber 77 to be large enough to combust a pre-mixed air-fuel mixture.

As shown in FIG. 1, the burner head 55, the inner surface of the first tube 30, and the orifice plate 40 define and form the second mixing chamber 72. The second mixing chamber 72 is connected to the first mixing chamber 71 through the orifice hole 40A. The first mixing chamber 71 and the second mixing chamber 72 form a premixing chamber 73.

The burner head 55, the first tube 30, and the ejection plate 31 form a combustion chamber 77 for generating the flame F. The combustion chamber 77 is connected to the second mixing chamber 72 through the supply holes 55A formed on the burner head 55, and connected to the DPF 12 through the ejection port 32. An insertion hole, which extends through the first tube 30, is formed in the combustion chamber 77 and at a position closer to the burner head 55 than the location of the second introduction holes 36. The ignition portion 62 of a spark plug 61 is inserted into the insertion hole.

As shown in FIG. 1, the second tube 60 is fixed to the basal plate 21 to be coaxial with the first tube 30, and has the opening at the bottom closed by the basal plate 21. An annular closing plate 63 closes the space between the inner surface of the second tube 60 and the outer surface of the first tube 30 at a part closer to the head opening.

Figure 5:
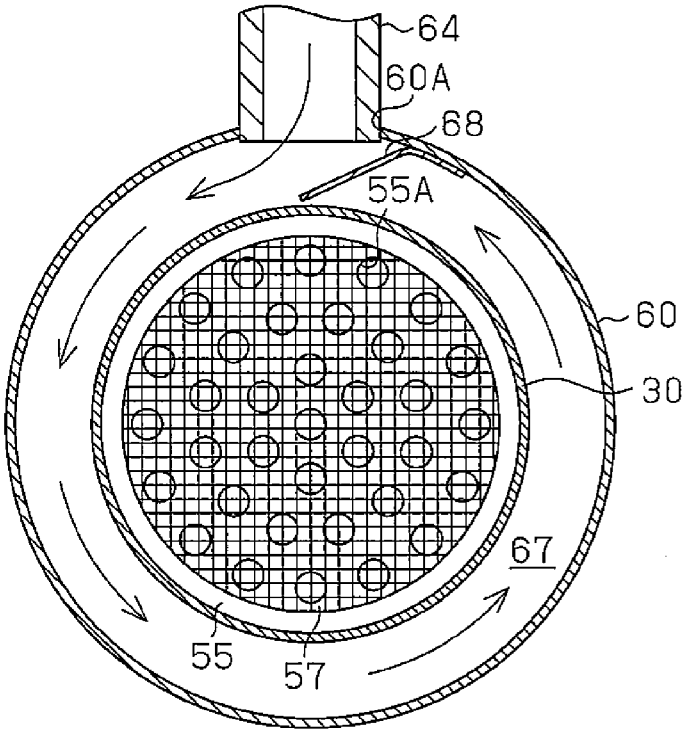
FIG. 5 is a cross-sectional view taken along line 5-5 of FIG. 1.

An air supply port 60A, at which the inlet of the air supply passage 64 is fixed, is arranged closer to the head opening of the second tube 60. The second tube 60 includes the air supply port 60A arranged closer to the head opening than the second introduction holes 36 formed on the first tube 30. As shown in FIG. 5, the inner surface of the second tube 60 includes a guide plate 68 arranged near the opening of the air supply port 60A. The guide plate 68 is fixed to the second tube 60 in a cantilever-like manner in a state that the lateral face of the guide plate 68 is inclined in the direction along the inner surface of the second tube 60. The guide plate 68 is inclined in the same direction as the raised pieces 35 on the first tube 30.

As shown in FIG. 1, the air supply passage 64 includes the intake passage 13 of the engine 10 at the upstream end and is connected to the downstream side of a compressor 15, which rotates with a turbine 14 arranged in the exhaust passage 11.

The air supply passage 64 further includes an air valve 65 capable of changing the cross-sectional area of the flow path in the air supply passage 64. A control unit, not shown, controls opening and closing of the air valve 65. When the air valve 65 is in an open state, a portion of intake air that flows through the intake passage 13 is introduced into the second tube 60 from the air supply passage 64.

An annular distribution chamber 67 is arranged between the inner surface of the second tube 60 and the outer surface of the first tube 30 to distribute air for combustion to the first mixing chamber 71 and the combustion chamber 77. As shown in FIG. 5, the distribution chamber 67 surrounds the first tube 30 via the circumferential wall of the first tube 30. That is, the distribution chamber 67 is connected to the first mixing chamber 71 through the first introduction holes 34 arranged at the basal end portion of the first tube 30, and connected to the combustion chamber 77 through the second introduction holes 36 formed substantially at the center of the first tube 30.

Operation of the burner 20 in the first embodiment will now be described.

When a regeneration process of the DPF 12 starts, the air valve 65 is maintained in the open state, and the fuel supply unit 37 and the spark plug 61 are activated. When the air valve 65 is in the open state, a portion of intake air that flows through the intake passage 13 is introduced to the distribution chamber 67 as air for combustion from the air supply passage 64 through the air supply port 60A. At this time, as shown in FIG. 5, the guide plate 68 guides the air for combustion, thereby suppressing a flow against the inclined guide plate 68. As shown by the arrows in FIG. 5, the air for combustion keeps swirling in a predetermined direction and flows in the opposite direction to the direction toward the ejection port 32.

A portion of the air for combustion introduced to the distribution chamber 67 is introduced to the combustion chamber 77 through the second introduction holes 36. As shown in FIG. 2, the remaining portion of the air for combustion is introduced to the first mixing chamber 71 through the first introduction holes 34. As described above, the guide plate 68 and the raised pieces 35 are inclined in the same direction. Thus, the air for combustion does not lose force for swirling. Rather, the air for combustion gains force for swirling and is introduced to the first mixing chamber 71.

The swirling flow generated by the raised pieces 35 flows toward the orifice hole 40A while converging to the central part of the first tube 30 in the radial direction, which is a region to which the fuel supply unit 37 supplies fuel. As described above, the position of the orifice hole 40A is arranged on the injection center line L1, and the center of the swirl of the air for combustion overlaps with the fuel ejection direction of the fuel supply unit 37. Fuel is caught in the swirling flow and spreads outward from the center of the swirling flow. A large portion of the injected fuel passes through the orifice hole 40A. This prevents fuel from spreading toward the inner surface of the first tube 30, and suppresses unnecessary fuel consumption.

The pre-mixed air-fuel mixture, in which air for combustion and fuel are mixed, keeps swirling in a predetermined direction and is discharged to the second mixing chamber 72 after forming a contracted flow through the outlet of the orifice hole 40A. The pre-mixed air-fuel mixture has uneven fuel concentration distribution when being discharged from the orifice hole 40A. However, the contracted flow is formed near the outlet of the orifice hole 40A. This generates great shear force near the outlet of the orifice hole 40A, and the pre-mixed air-fuel mixture is further mixed in the second mixing chamber 72. The downstream pressure of the orifice hole 40A decreases to be less than the upstream pressure, and the mixed air-fuel mixture spreads throughout the second mixing chamber 72.

The orifice hole 40A of the orifice plate 40 shown in FIG. 3 has a diameter D1. The second mixing chamber 72 has an inner diameter D (refer to FIG. 1). Preferably, the ratio of the diameter D1 of the orifice hole 40A to the inner diameter D of the second mixing chamber 72, or an orifice hole ratio D1/D, is in a range between 0.25 and 0.33, inclusive. The diameter D1 of the orifice hole 40A is set so that the ratio is within the above range. This increases fuel distribution uniformity of the pre-mixed air-fuel mixture. The term, fuel distribution uniformity, refers uniformity of the fuel concentration distribution in the pre-mixed air-fuel mixture in the radial direction of the first tube 30 immediately before being supplied to the combustion chamber 77.

A method for calculating the fuel distribution uniformity will now be described. A fuel concentration is measured at a plurality of measurement points in the combustion chamber 77. A degree of dispersion of concentration in a group of concentrations measured at the measurement points is calculated from the following formula. Here, r is a value of the fuel distribution uniformity, n is the number of measurement points of fuel concentration, $\phi_i$ is a fuel concentration measured at each measurement point, $\phi_{ave}$ is an average of the fuel concentrations. The formula indicates that the fuel distribution uniformity increases as r comes closer to 1.

$$r = 1 - \frac{1}{2n} \cdot \frac{\sum |\phi i - \phi_{ave}|}{\phi_{ave}} \quad \text{[Formula 1]}$$

Figure 6A:
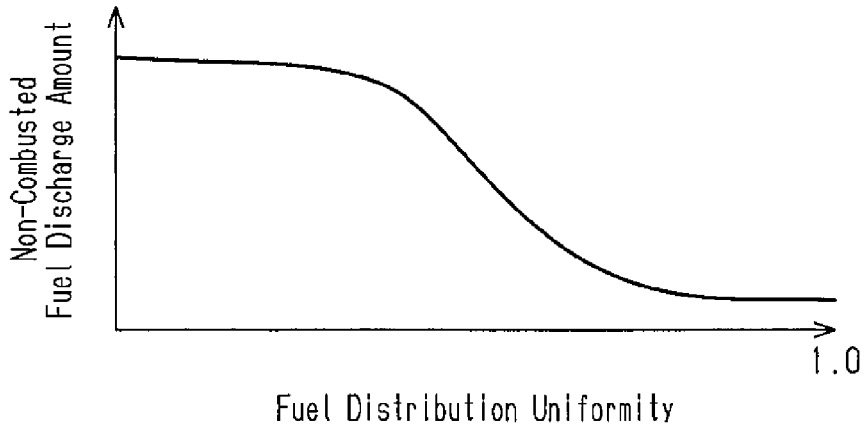
FIG. 6A is a graph that shows a relationship between uniformity of fuel distribution and a non-combusted fuel discharge amount.
Figure 6B:
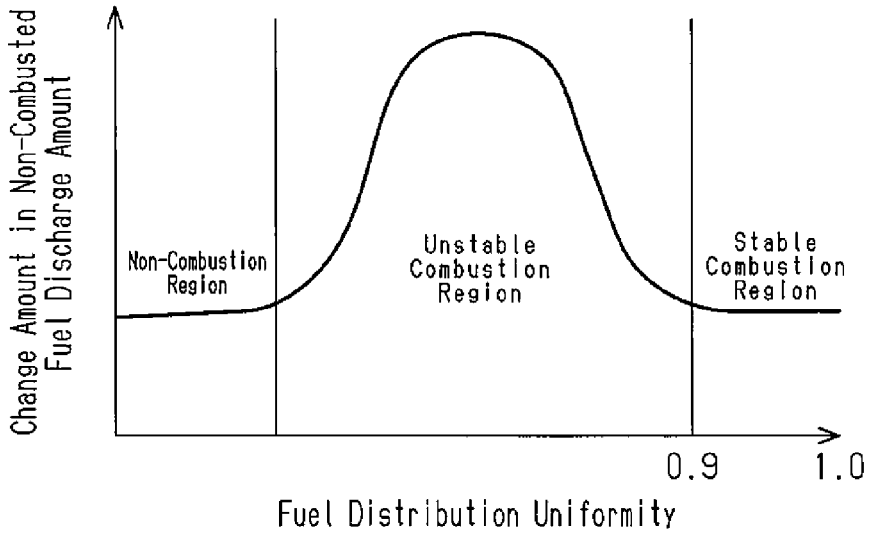
FIG. 6B is a graph that shows a relationship between uniformity of fuel distribution and combustion stability.

The horizontal axis of FIG. 6A represents fuel distribution uniformity, and the vertical axis represents a non-combusted fuel discharge amount, which is an amount of non-combusted fuel contained in post-combustion gas to be discharged. As the fuel distribution uniformity r, calculated from the above formula, comes closer to 1, the non-combusted fuel discharge amount (HC value) in the post-combustion gas decreases while forming an S curve. FIG. 6B shows a curve obtained by differentiating the curve. The curve shown in FIG. 6B is a graph that shows a relationship between a change amount in the discharged non-combusted fuel and the fuel distribution uniformity. When the fuel distribution uniformity has a value less than 0.9 on the graph, the non-combusted fuel discharge amount greatly changes, or is unstable due to incomplete combustion of fuel. When the fuel distribution uniformity has a value greater than or equal to 0.9, combustion phenomenon and the non-combusted fuel discharge amount are stabilized. For this reason, a lower limit value (referred to as an acceptable lower limit value) in a preferable range of fuel distribution uniformity is set to be 0.9.

Figure 7A:
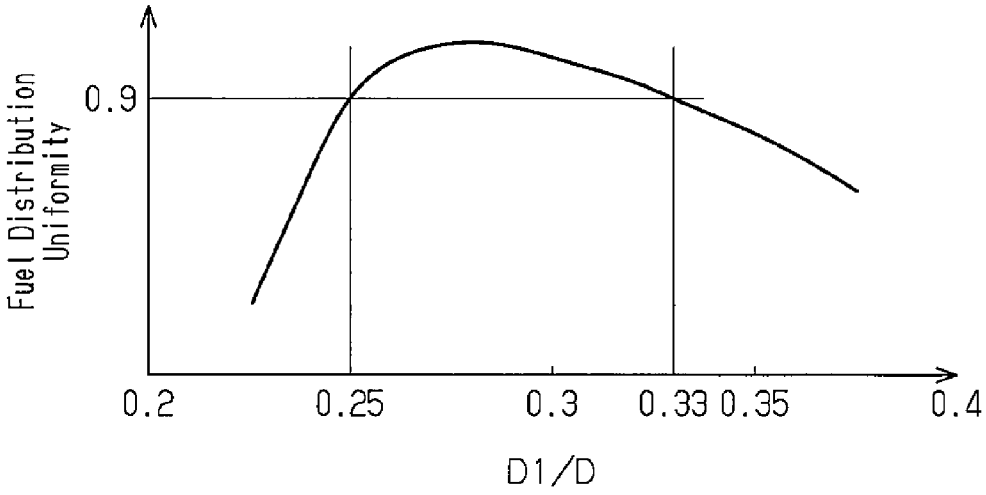
FIG. 7A is a graph that shows a relationship between the ratio of the diameter of an orifice hole to the inner diameter of a tube and uniformity of fuel distribution.

Using the acceptable lower limit value of fuel distribution uniformity, the ratio between the diameter D1 of the orifice hole 40A and the inner diameter D of the second mixing chamber 72 (orifice hole ratio D1/D) is optimized. Using orifice plates having orifice holes with different diameters, a value of the fuel distribution uniformity is calculated based on the aforementioned method and formula. As shown in FIG. 7A, when the orifice hole ratio D1/D is within a range between 0.25 and 0.33, inclusive, the fuel distribution uniformity has a value greater than or equal to 0.9. The ratio of the length L to the diameter D of the second mixing chamber 72 (refer to FIG. 1), or a second mixing chamber ratio L/D, is set to be 0.8. When the orifice hole ratio D1/D is less than the above range, gas passing through the orifice hole 40A has an increased flow velocity, and does not sufficiently spread downstream of the orifice. When the orifice hole ratio D1/D is beyond the above range, the pressure dose not decrease well in gas passing through the orifice hole 40A, and the gas does not sufficiently spread downstream of the orifice.

Figure 7B:
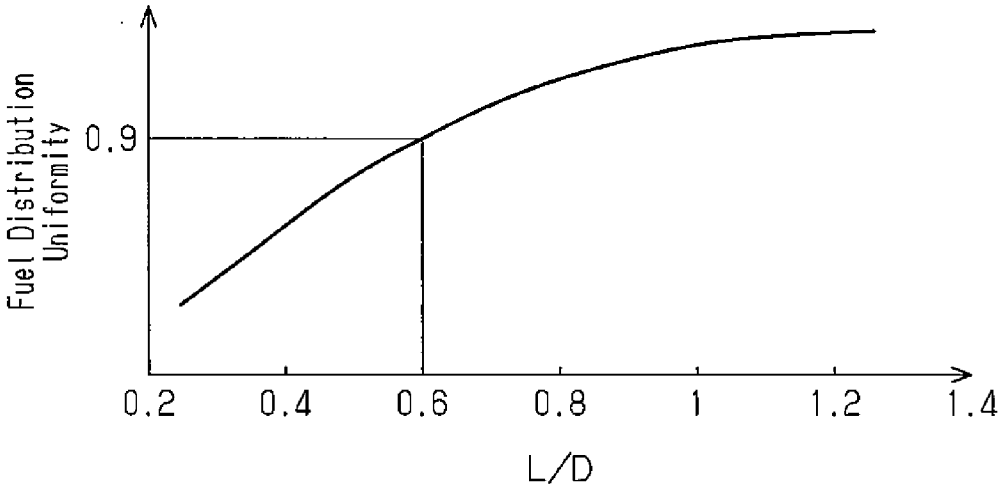
FIG. 7B is a graph that shows a relationship between the ratio of the length of the second mixing chamber to the inner diameter of the tube and uniformity of fuel distribution.

Moreover, in order to increase the effect of the orifice, the length of the second mixing chamber 72 is also optimized. As shown in FIG. 7B, when the ratio of length L to the inner diameter D of the second mixing chamber 72 (second mixing chamber ratio L/D) is greater than or equal to 0.6, the fuel distribution uniformity has a value greater than or equal to 0.9. Here, the orifice hole ratio D1/D is set to 0.3.

In this way, the pre-mixed air-fuel mixture, which is mixed in the second mixing chamber 72, is introduced to the combustion chamber 77 through the supply holes 55A of the burner head 55. When the ignition portion 62 ignites the pre-mixed air-fuel mixture flowing into the combustion chamber 77, flame F is formed in the combustion chamber 77. The pre-mixed air-fuel mixture is combusted to generate post-combustion gas. At this time, as shown in FIG. 1, the distribution chamber 67 supplies air for combustion downstream of the ignition portion 62 through the second introduction holes 36. As a result, the air for combustion and the post-combustion gas are exchanged to promote combustion.

The post-combustion gas generated in the combustion chamber 77 is supplied to the exhaust passage 11 through the ejection port 32 and is mixed with exhaust in the exhaust passage 11. This raises the temperature of exhaust flowing into the DPF 12. In the DPF 12, into which such exhaust flows, the temperature rises to a target temperature to incinerate particulates captured by the DPF 12.

When the pre-mixed air-fuel mixture is combusted in the combustion chamber 77, the first tube 30 is heated with high-temperature post-combustion gas. For this reason, after combustion starts, heat transferred from the first tube 30 raises the temperature of air for combustion flowing through the distribution chamber 67. The air for combustion with the raised temperature is introduced to the first mixing chamber 71 through the first introduction holes 34. This suppresses already evaporated fuel from liquefying and promotes evaporation of fuel liquidized at that time after combustion starts. The air for combustion in the distribution chamber 67 swirls around the first tube 30. Thus, gas of combustion has a longer path in the distribution chamber 67 as compared to a laminar flow, which linearly flows toward the first introduction holes 34 from the air supply passage 64. The air for combustion with a higher temperature is introduced to the first mixing chamber 71, thereby reducing the non-combusted fuel amount in the pre-mixed air-fuel mixture.

Figure 8:
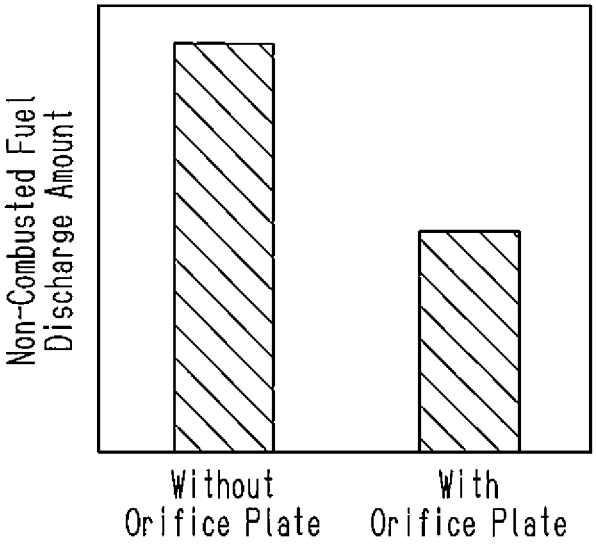
FIG. 8 is a graph that shows comparison between non-combusted fuel discharge amounts when the burner in FIG. 1 includes an orifice plate and when the orifice plate is omitted.

FIG. 8 shows an experimental result that compares an amount of non-combusted fuel discharged (non-combusted fuel discharge amount) by the burner 20 including the orifice plate 40 to an amount of non-combusted fuel discharged by a burner without the orifice plate 40. A burner including the orifice plate 40, which was the burner 20 of the present embodiment, was observed to have a less non-combusted fuel discharge amount than the burner without the orifice plate 40.

As described above, the first embodiment provides the advantages listed below.

(1) The first tube 30 includes the premixing chamber 73 between the fuel supply port 21A and the combustion chamber 77, the first introduction holes 34, and the raised pieces 35. The first tube 30 includes the swirling flow generation unit for generating a swirling flow of which the center direction corresponds to the fuel injection direction. For this reason, when injecting fuel toward the center of the swirling flow, the fuel is caught in the swirling flow and spreads outward from the center of the swirling flow. Further, the orifice plate 40 diffuses the fuel in the second mixing chamber 72. This minimizes the unevenness in the concentration distribution of the fuel in the pre-mixed air-fuel mixture even if the fuel is injected to the center of the first mixing chamber 71. Thus, the concentration distribution of the fuel is homogenized in the radial direction of the first tube 30 before the pre-mixed air-fuel mixture is supplied to the combustion chamber 77. This reduces the discharge amount of non-combusted fuel, which results from the unevenness in the fuel concentration distribution.

(2) The orifice plate 40 is arranged downstream of the raised pieces 35 (closer to the ejection port 32). The pre-mixed air-fuel mixture remains in the swirling state and passes through the orifice hole 40A. Then, the pre-mixed air-fuel mixture is discharged downstream of the orifice hole 40A. When a contracted flow with an increased flow velocity is formed around the outlet of the orifice hole 40A, the pressure of the second mixing chamber 72 decreases to be lower than the pressure near the orifice hole 40A in the first mixing chamber 71. Thus, the swirling fuel in the contracted flow spreads at once in the second mixing chamber 72. For this reason, the fuel concentration distribution of the pre-mixed air-fuel mixture supplied to the combustion chamber 77 is homogenized in the radial direction of the first tube 30.

(3) The orifice hole 40A is arranged on the injection center line L1, which represents the center of fuel injection. For this reason, before the injected fuel spreads to reach the inner surface of the first tube 30, a large amount of the injected fuel is discharged to the second mixing chamber 72 in the contracted flow. For this reason, unnecessary fuel consumption is suppressed.

(4) The ratio of the diameter of the orifice hole 40A to the inner diameter of the first tube 30 (orifice hole ratio D1/D) is in a range between 0.25 and 0.33, inclusive. The pre-mixed air-fuel mixture is supplied to the combustion chamber 77 with an even fuel concentration in the radial direction of the first tube 30.

(5) The burner head 55, which has a plurality of supply holes 55A, is arranged between the premixing chamber 73 and the combustion chamber 77. For this reason, the burner head 55 suppresses backfire from the combustion chamber 77, and the generation of swirling flow is more stable in the second mixing chamber 72 than when the burner head 55 is not arranged. This improves mixing efficiency in the second mixing chamber 72, and the pre-mixed air-fuel mixture with less uneven fuel concentration distribution is supplied to the combustion chamber 77.

Second Embodiment

A second embodiment of the present invention will now be described with reference to FIG. 9 to FIG. 12. The second embodiment only differs from the first embodiment in the orifice plate. Like reference characters designate like or corresponding parts and the parts will not be described in detail.

Figure 9:
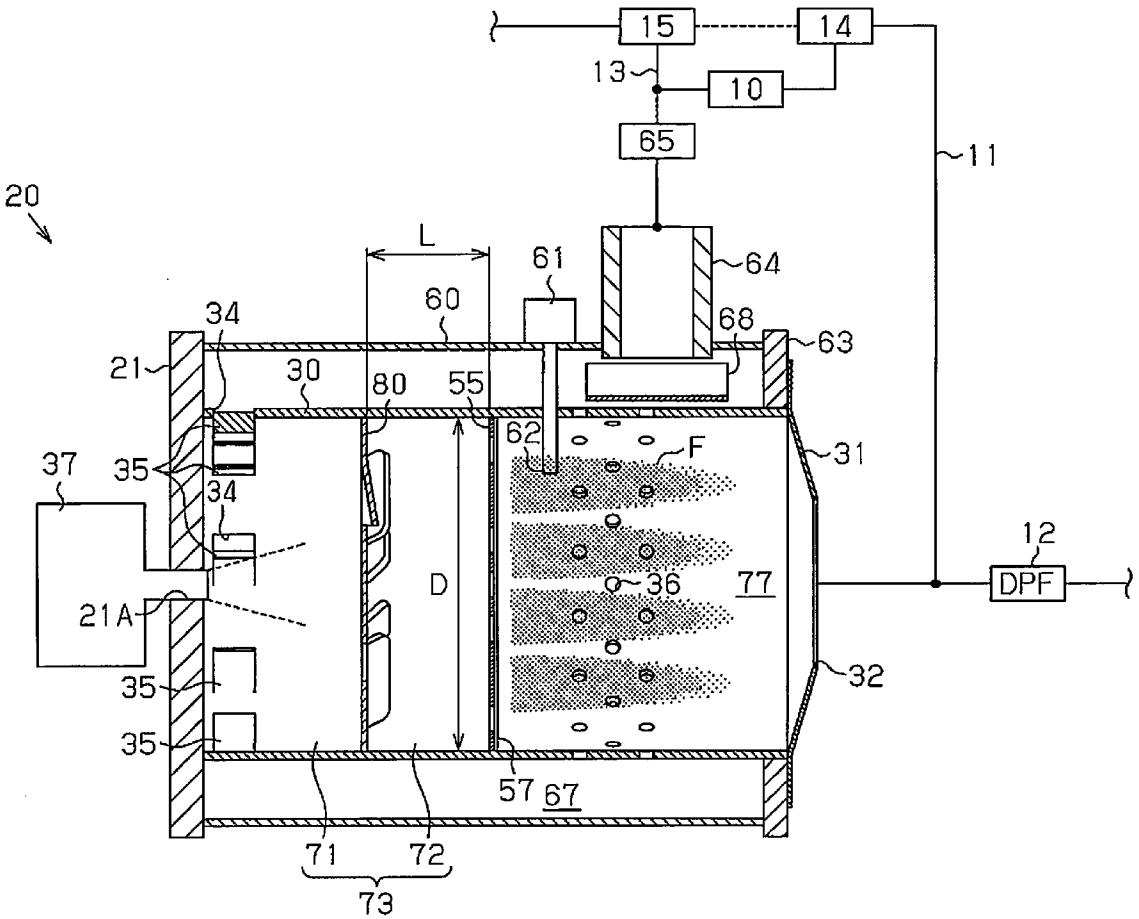
FIG. 9 is a schematic view of a burner for an exhaust purifying device according to a second embodiment of the present invention.
Figure 10:
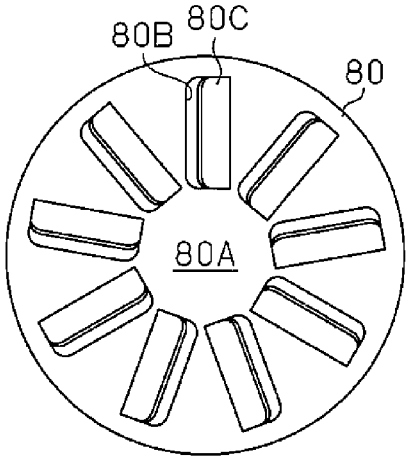
FIG. 10 is a plan view of a swirler plate arranged in the burner in FIG. 9.

As shown in FIG. 9, the burner 20 of the second embodiment includes a substantially disc-shaped swirler plate 80 as a diffusion unit, which is substituted for the orifice plate 40 of the first embodiment. As shown in FIG. 10, a circular closing portion 80A as a shielding portion is arranged in the center of the swirler plate 80. A plurality of swirler openings 80B is formed in an annular region surrounding the closing part 80A. A substantially C-shaped cut portion is formed in the swirler plate 80, and the cut portion is cut and raised to form a swirler opening 80B.

A swirler 80C is arranged at a side of each swirler opening 80B. Nine swirlers 80C are formed at angular intervals of 40° in the circumferential direction of the swirler plate 80. Each swirler 80C is inclined at a predetermined angle, and the inclination direction is the same as that of the raised pieces 35 on the first tube 30.

Operation of the burner 20 in the second embodiment will now be described. Similar to the first embodiment, the distribution chamber 67 distributes a flow of air for combustion to the first mixing chamber 71 and the combustion chamber 77. When passing through the first introduction holes 34, the air for combustion is swirled by the raised pieces 35 and introduced to the first mixing chamber 71.

When the fuel supply unit 37 injects fuel to the center of the swirling flow, the air for combustion incorporates the fuel while swirling. A large amount of evaporated fuel hits the closing part 80A of the swirler plate 80. After hitting the closing part 80A, the fuel radially spreads from the closing part 80A in the first mixing chamber 71. The fuel is caught in the swirling flow in the first mixing chamber 71 and mixed with the air for combustion to generate a pre-mixed air-fuel mixture. The pre-mixed air-fuel mixture including the air for combustion and the fuel is introduced to the second mixing chamber 72 through the swirler openings 80B.

Figure 11A:
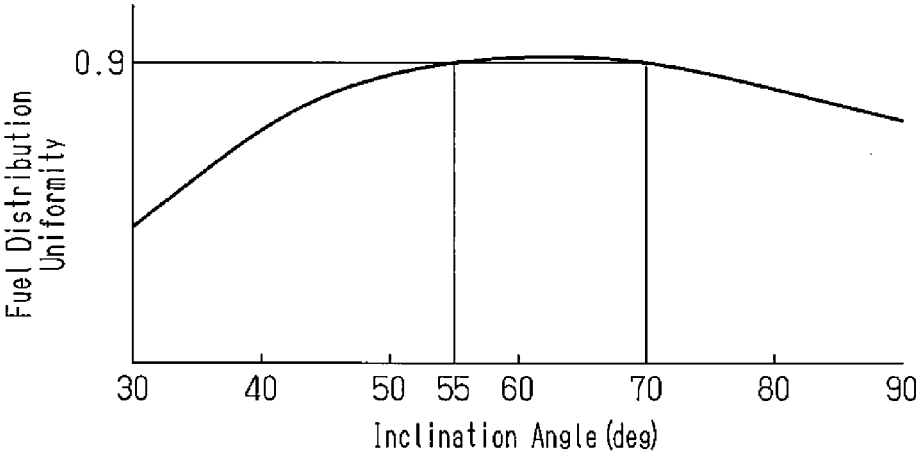
FIG. 11A is a graph that shows a relationship between a cut-and-raised angle of a swirler on the swirler plate and uniformity of fuel distribution.
Figure 11B:
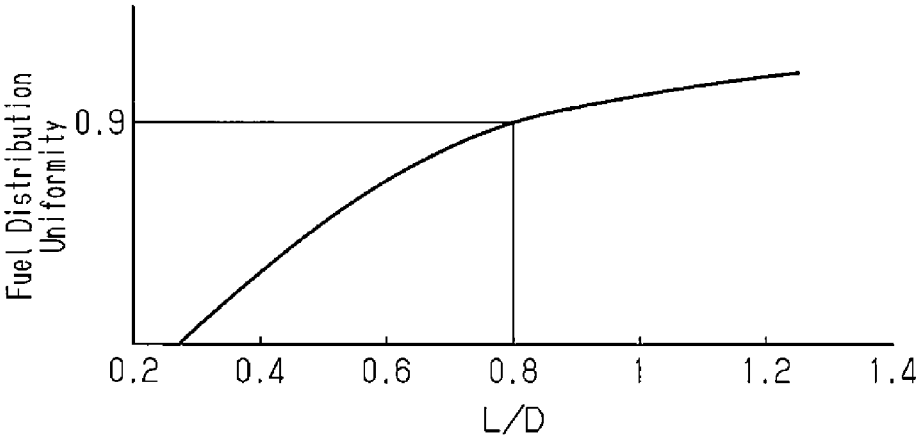
FIG. 11B is a graph that shows a relationship between the ratio of the length of the second mixing chamber to the inner diameter of the tube and uniformity of fuel distribution.

Preferably, the swirlers 80C are inclined at an angle greater than or equal to 55° and less than or equal to 70° relative to the closing part 80A or the main surface of the swirler plate 80. As shown in FIG. 11A, when the inclination angle is out of the above range, the value of the fuel distribution uniformity falls below the acceptable lower limit value described in the first embodiment. As a possible cause, when the inclination angle is below the above range, the flow volume decreases in the pre-mixed air-fuel mixture passing through the swirler openings 80B, and an insufficient volume of the pre-mixed air-fuel mixture is supplied to the combustion chamber 77. When the inclination angle is beyond the above range, the swirling flow does not have enough force. Preferably, as shown in FIG. 11B, the ratio of the length L to the inner diameter D of the second mixing chamber 72 (second mixing chamber ratio L/D) is greater than or equal to 0.8. When the ratio L/D is less than 0.8, the value of the fuel distribution uniformity falls below the above acceptable lower limit value. As a possible cause, when the ratio L/D is less than 0.8, the swirling pre-mixed air-fuel mixture has a shorter path length in the first mixing chamber 71, and the mixing efficiency of air for combustion and fuel decreases in the pre-mixed air-fuel mixture.

The pre-mixed air-fuel mixture sent out from the swirler openings 80B swirls in a predetermined direction in the second mixing chamber 72 and spreads throughout the second mixing chamber 72. The pre-mixed air-fuel mixture is introduced to the combustion chamber 77 through the supply hole 55A of the burner head 55. When the ignition portion 62 ignites the pre-mixed air-fuel mixture, flame F formed in the combustion chamber 77 combusts the pre-mixed air-fuel mixture to generate post-combustion gas. The distribution chamber 67 supplies the air for combustion to near and downstream of the ignition portion 62 thorough the second introduction hole 36.

The post-combustion gas generated in the combustion chamber 77 is supplied to the exhaust passage 11 through the ejection port 32. The post-combustion gas mixed with exhaust in the exhaust passage 11 raises the temperature of exhaust flowing in the DPF 12. When the DPF 12 draws in such exhaust, the temperature rises to the target temperature to incinerate particulates captured by the DPF 12.

Figure 12:
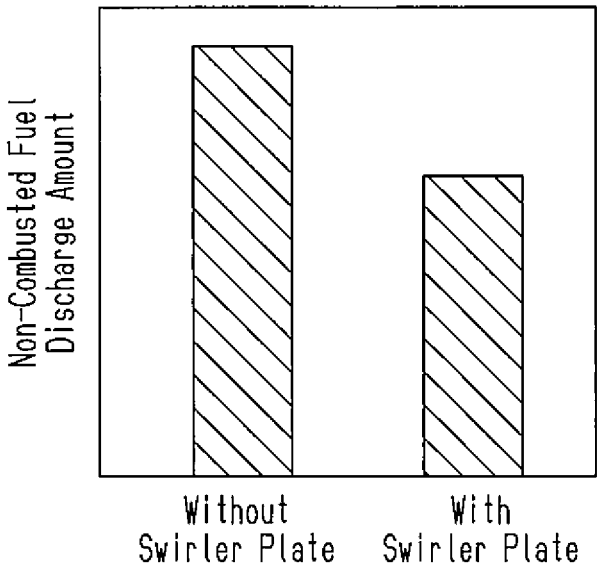
FIG. 12 is a graph that shows comparison between non-combusted fuel discharge amounts when the burner in FIG. 9 includes a swirler plate and when the swirler plate is omitted.

FIG. 12 shows an experimental result that compares an amount of non-combusted fuel discharged (non-combusted fuel discharge amount) by the burner 20 including the swirler plate 80 to an amount of non-combusted fuel discharged by a burner without the swirler plate 80. A burner including the swirler plate 80, which was the burner 20 of the present embodiment, was observed to have a less non-combusted fuel discharge amount than the burner without the swirler plate 80.

Thus, the second embodiment provides the following advantages in addition to the advantages (1) to (5) described in the first embodiment.

(6) The swirler plate 80 functions as a diffusion unit for diffusing the injected fuel toward the combustion chamber 77. The swirler plate 80 includes the closing part 80A facing in the fuel injection direction, the swirler openings 80B arranged around the closing part 80A, and the swirlers 80C each arranged at the side of a swirler opening 80B. The fuel injected toward the center of the swirling flow hits the closing part 80A. This generates shear force in the pre-mixed air-fuel mixture and promotes mixture of fuel and air for combustion. When the mixed pre-mixed air-fuel mixture is discharged to the second mixing chamber 72 through the swirler openings 80B, the swirlers 80C generate a swirling flow. The swirling flow further mixes the pre-mixed air-fuel mixture downstream of the premixing chamber. For this reason, fuel concentration distribution of the pre-mixed air-fuel mixture supplied to the combustion chamber 77 is homogenized.

(7) The swirlers 80C, which generate a swirling flow, have an inclination angle greater than or equal to 55° and less than or equal to 70°. Thus, the pre-mixed air-fuel mixture is supplied to the combustion chamber 77 with an even fuel concentration in the radial direction of the first tube 30.

The embodiments described above may be modified in the forms described below.

The burner 20 of the first embodiment includes the orifice plate 40 as a diffusion unit, and the burner 20 of the second embodiment includes the swirler plate 80 as a diffusion unit. However, the burner 20 may include both the orifice plate 40 and the swirler plate 80. The orifice plate 40 and the swirler plate 80 may be arranged in either order along the flow of the pre-mixed air-fuel mixture. However, by arranging the orifice plate 40 immediately downstream of the fuel supply port, a more amount of injected fuel is discharged downstream of the orifice hole 40A.

The first embodiment uses the orifice plate 40 as a diffusion unit. However, the diffusion unit may be a funnel-shaped pipe line of which the inner diameter continuously decreases from the inlet to the outlet, a Venturi tube, or the like. In sum, the diffusion unit may be modified as long as it includes a connecting hole with the diameter less than the inner diameter of the first tube 30.

In the above embodiments, the second tube 60 may be omitted if it is possible to supply air for combustion to the basal end side of the first tube 30.

The air supply port 60A may be formed at a position not close to the head portion. For example, the air supply port 60A may be formed at the central portion of the second tube 60. Alternatively, a plurality of air supply ports 60A may be provided.

In the above embodiments, the swirling flow generation unit includes the raised pieces 35, which are cut and raised inward. However, different arrangement may be applied such as a swirl vane arranged around the first tube 30.

In the above embodiments, the fuel supply unit 37 is a type of device to evaporate fuel in the interior. However, the fuel supply unit 37 may be a type of device to spray liquid fuel in the first tube 30.

The ignition portion 62 may include a glow plug, a laser spark device, and a plasma spark device in addition to the spark plug. Alternatively, if it is possible to generate flame F, the ignition portion 62 may include only one of the glow plug, laser spark device, and plasma spark device.

Not limited to intake air flowing through the intake passage 13, air for combustion may be air that flows in a pipe connected to the air tank of the brake, or air supplied by the blower of the burner for an exhaust purifying device.

Not limited to the DPF 12, the exhaust purifying device may be a device including a catalyst for purifying exhaust gas. In this case, the burner 20 raises the temperature of the catalyst and therefore, the temperature promptly rises to the activation temperature.

An engine including the burner for an exhaust purifying device may be a gasoline engine.

What is claimed is:

1. A burner for an exhaust purifying device comprising:

a tube, which includes:

a premixing chamber for mixing air for combustion and fuel to generate a pre-mixed air-fuel mixture;

a combustion chamber for combusting the pre-mixed air-fuel mixture to generate post-combustion gas; and a discharge port for discharging the post-combustion gas;

an air supply port for supplying the air for combustion into the tube;

a fuel supply port for supplying fuel into the tube; and an ignition portion for igniting the pre-mixed air-fuel mixture in the combustion chamber, wherein the premixing chamber includes a first mixing chamber and a second mixing chamber, the second mixing chamber connected to the first mixing chamber and the combustion chamber, the tube further includes:

a swirling flow generation unit, which is arranged upstream of the first mixing chamber and is configured to generate a swirling flow of which a center direction corresponds to a fuel injection direction; and a diffusion unit, which is arranged between the first mixing chamber and the second mixing chamber and is configured to diffuse the fuel incorporated in the swirling flow; and the diffusion unit includes a connecting hole having a diameter less than the inner diameter of the tube.

2. The burner for an exhaust purifying device according to claim 1, wherein the connecting hole of the diffusion unit is arranged on an injection center line in the fuel injection direction.

3. The burner for an exhaust purifying device according to claim 1, wherein a ratio of the diameter of the connecting hole to the inner diameter of the tube is within a range between 0.25 and 0.33, inclusive.

4. The burner for an exhaust purifying device according to claim 1, wherein the diffusion unit includes a shielding portion facing in the fuel injection direction, an opening arranged around the shielding portion, and a swirler for swirling the pre-mixed air-fuel mixture sent from the opening in a predetermined direction.

5. The burner for an exhaust purifying device according to claim 4, wherein the swirler is inclined relative to the shielding portion at an angle in a range from 55° to 70°, inclusive.

6. The burner for an exhaust purifying device according to claim 1, the burner further comprising a porous plate arranged between the premixing chamber and the combustion chamber.

* * * * *